US006260222B1

(12) United States Patent
Lin

(10) Patent No.: US 6,260,222 B1
(45) Date of Patent: Jul. 17, 2001

(54) AIR MATTRESS STRUCTURE

(75) Inventor: Ping-Ting Lin, Taichung Hsien (TW)

(73) Assignee: Feng Yi Outdoor Leisure Equipment Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/351,920

(22) Filed: Jul. 14, 1999

(51) Int. Cl.[7] ..... A47C 27/08
(52) U.S. Cl. ..... 5/709; 5/706; 5/420
(58) Field of Search ..... 5/706, 709, 737, 5/740, 713 AM, 420

(56) References Cited

U.S. PATENT DOCUMENTS

| | | | | |
|---|---|---|---|---|
| Re. 31,898 | * | 5/1985 | Suter | 5/709 X |
| 3,574,873 | * | 4/1971 | Weinstein | 5/737 X |
| 3,675,377 | * | 7/1972 | Suter | 5/709 X |
| 4,025,974 | * | 5/1977 | Lea et al. | 5/709 |
| 4,319,781 | * | 3/1982 | Tsuge | 5/925 X |
| 4,357,725 | * | 11/1982 | Ahlm | 5/740 |
| 4,450,193 | * | 5/1984 | Staebler | 5/420 X |
| 4,520,517 | * | 6/1985 | Ahlm | 5/740 |
| 5,152,018 | * | 10/1992 | Lea | 5/709 X |
| 5,226,384 | * | 7/1993 | Jordan | 5/420 X |
| 5,669,092 | * | 9/1997 | Lin | 5/706 |
| 6,190,486 | * | 2/2001 | Switlik | 5/420 X |

* cited by examiner

*Primary Examiner*—Michael F. Trettel
*Assistant Examiner*—Robert G. Santos
(74) *Attorney, Agent, or Firm*—Rosenberg, Klein & Lee

(57) ABSTRACT

An air mattress structure includes a mattress body including a sponge layer having a first face and a second face, a first line low density polyethylene layer laminated on the first surface of the sponge layer, a first nylon layer laminated on the first line low density polyethylene layer, a second line low density polyethylene layer laminated on the second surface of the sponge layer, and a second nylon layer laminated on the second line low density polyethylene layer. Thus, the air mattress structure consisting of the above-mentioned elements has a simple construction, and is transparent so that a user can see the inflation and squeeze of the sponge layer.

1 Claim, 3 Drawing Sheets

AIR MATTRESS STRUCTURE

BACKGROUND OF THE INVENTION

1. Field of the Invention

The present invention relates to an inflatable air mattress.

2. Description of the Related Prior Art

A conventional air mattress structure 10 is shown in FIGS. 1 and 2, and comprises a sponge layer 13, an upper cloth layer 11 coated on the top face of the sponge layer 13, a lower cloth layer 12 coated on the bottom face of the sponge layer 13, and a polyvinyl chloride (P.V.C.) layer 14 sandwiched between the upper cloth layer 11 and the top face of the sponge layer 13. In use, when the inflation valve (not shown) is opened, air is introduced into the inside of the air mattress structure 10 so as to inflate the sponge layer 13 so that the air mattress structure 10 can be placed on the ground to be used as a seating mat or a sleeping bag. When the air mattress structure 10 is not in use, the inflation valve can be opened again so that the air mattress structure 10 can be squeezed so as to drain the air out of the sponge layer 13. The inventor's prior art of an air mattress is disclosed in U.S. Pat. No. 5,669,092, entitled "AIR MATTRESS STRUCTURE". However, the above-mentioned prior arts are not transparent so that the user cannot see the inflation and squeeze process of the inside of the air mattress structure, thereby causing inconvenience to the user.

SUMMARY OF THE INVENTION

The primary objective of the present invention is to provide an inflatable air mattress structure comprising a mattress body including a sponge layer having a first face and a second face, a first line low density polyethylene layer laminated on the first surface of the sponge layer, a first nylon layer laminated on the first line low density polyethylene layer, a second line low density polyethylene layer laminated on the second surface of the sponge layer, and a second nylon layer laminated on the second line low density polyethylene layer. The first line low density polyethylene layer, the first nylon layer, the second line low density polyethylene layer, and the second nylon layer of the mattress body are transparent so that the inflation and the squeeze of the sponge layer are visible. The sponge layer is made with various colors, thereby enhancing the appearance and variance of the air mattress structure.

According to another form of the present invention, the sponge layer has a periphery, the first line low density polyethylene layer and the second line low density polyethylene layer are respectively secured to the periphery of the sponge layer with glue, the first nylon layer is laminated on the first line low density polyethylene layer, the second nylon layer is laminated on the second line low density polyethylene layer, and the surface area of each of the first line low density polyethylene layer, the first nylon layer, the second line low density polyethylene layer, and the second nylon layer is greater than that of the sponge layer, whereby the sponge layer is tightly enclosed in the laminated layers.

According to a further form of the present invention, the sponge layer has four sides, and the surface area of each of the first line low density polyethylene layer, the first nylon layer, the second line low density polyethylene layer, and the second nylon layer is greater than that of the sponge layer for enclosing all of the four sides of the sponge layer in the middle of the laminated layers.

Further objectives and advantages of the present invention will become apparent after a careful reading of the detailed description with reference to the accompanying drawings.

DETAILED DESCRIPTION OF THE PREFERRED EMBODIMENTS

Figure 1:
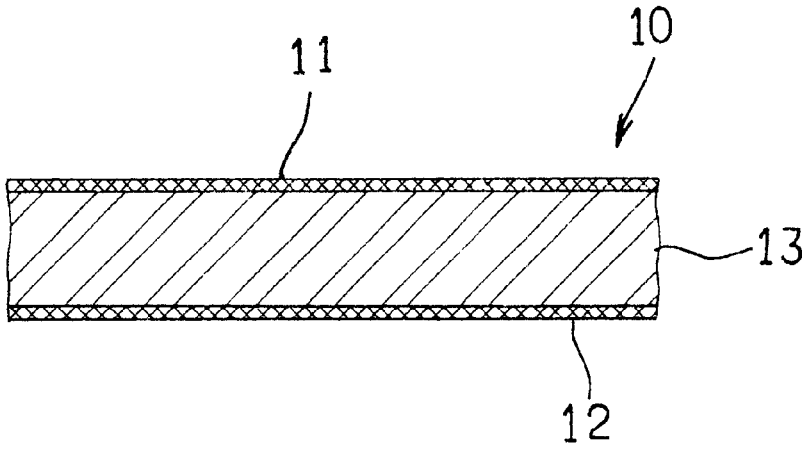
FIG. 1 PRIOR ART
FIG. 1 is a front cross-sectional view of a conventional air mattress structure according to the prior art.
Figure 2:
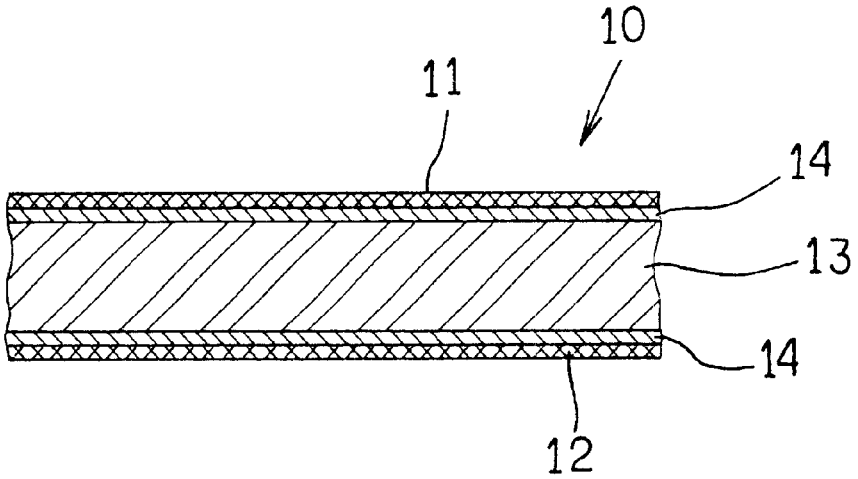
FIG. 2 PRIOR ART
FIG. 2 is a front cross-sectional view of the conventional air mattress structure as shown in FIG. 1.
Figure 3:
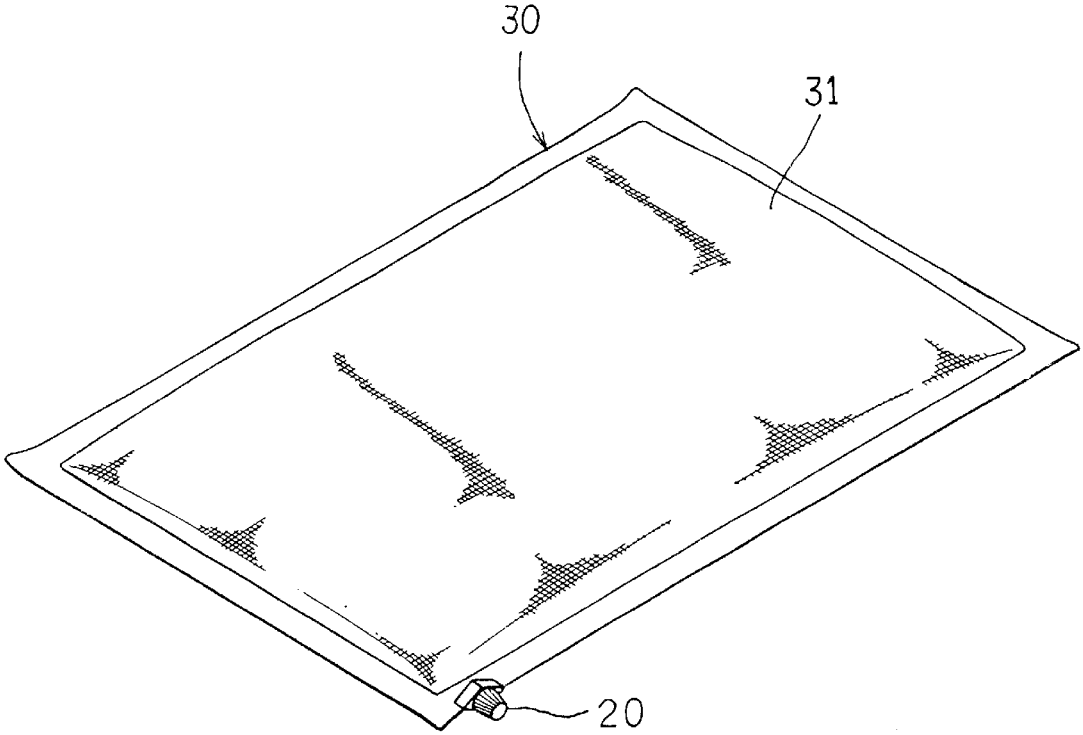
FIG. 3 is a perspective view of an inflatable air mattress structure according to the present invention.
Figure 4:
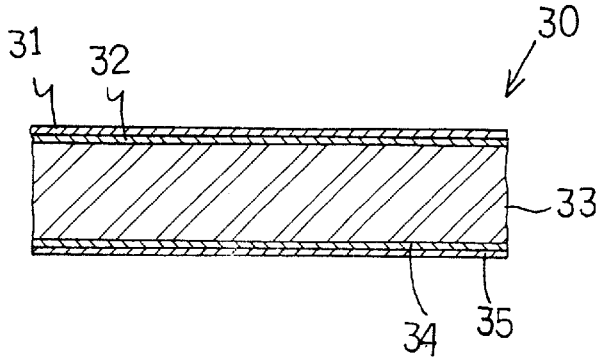
FIG. 4 is a front cross-sectional view of the inflatable air mattress structure as shown in FIG. 3.

With reference to FIGS. 3 and 4, an inflatable air mattress structure according to the present invention comprises a mattress body 30 and an inflation valve 20. The mattress body 30 includes a sponge layer 33 having a first face and a second face, a first line low density polyethylene (L.L.D.P.E.) layer 32 laminated on the first surface of the sponge layer 33, a first nylon layer 31 laminated on the first line low density polyethylene layer 32, a second line low density polyethylene (L.L.D.P.E.) layer 34 laminated on the second surface of the sponge layer 33, and a second nylon layer 35 laminated on the second line low density polyethylene layer 34.

In use, when the inflation valve 20 is opened, air is introduced into the inside of the air mattress structure so as to inflate the sponge layer 33 so that the inflatable air mattress structure can be placed on the ground to be used as a seating mat or a sleeping bag. The air mattress structure is water-tight, thereby preventing moisture from the ground from infiltrating into the sponge layer 33. In addition, the air mattress is heat insulating, thereby achieving a warm keeping function. When the air mattress structure is not in use, the inflation valve 20 can be opened again so that the air mattress structure can be squeezed so as to drain the air out of the sponge layer 33.

The first line low density polyethylene layer 32, the first nylon layer 31, the second line low density polyethylene layer 34, and the second nylon layer 35 of the mattress body 30 are made thin and transparent so that the inflation and the squeeze of the sponge layer 33 are visible by the user, thereby facilitating the user inflating or squeezing the air mattress structure. Thus, the air mattress structure according to the present invention has a simple construction, and is made transparent so that the user can see the inflation and squeeze process of the sponge layer 33. The sponge layer 33 can be made with various colors, thereby enhancing the appearance and variance of the air mattress structure.

Figure 5:
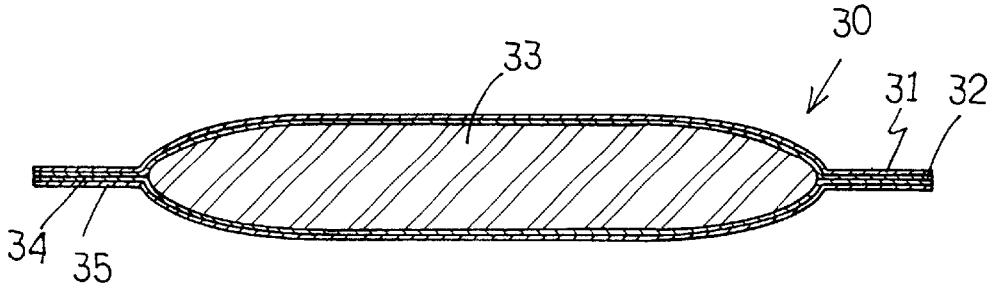
FIG. 5 is a front cross-sectional view of the inflatable air mattress structure according another embodiment of the present invention.

As shown in FIG. 5, according to another form of the present invention, the air mattress structure has an oval shape. The sponge layer 33 has a periphery, the first line low density polyethylene layer 32 and the second line low density polyethylene layer 34 are respectively secured to the periphery of the sponge layer 33 with glue, the first nylon layer 31 is laminated on the first line low density polyethylene layer 32, the second nylon layer 35 is laminated on the second line low density polyethylene layer 34, and the surface area of each of the first line low density polyethylene layer 32, the first nylon layer 31, the second line low density polyethylene layer 34, and the second nylon layer 35 is greater than that of the sponge layer 33, whereby the sponge layer 33 is tightly enclosed in the laminated layers.

Figure 6:
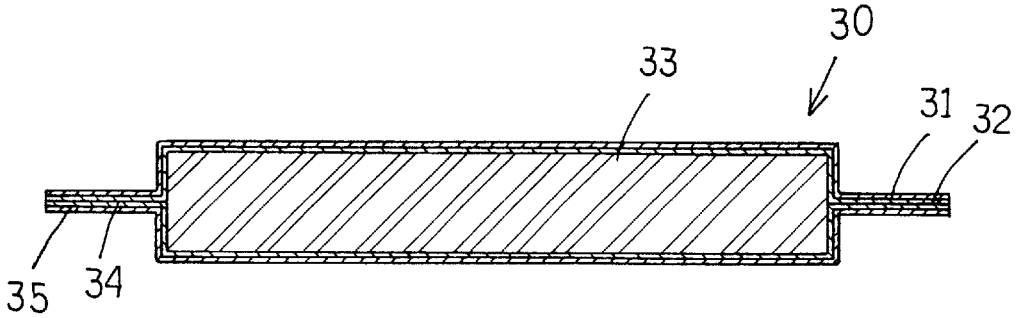
FIG. 6 is a front cross-sectional view of the inflatable air mattress structure according a further embodiment of the present invention.

As shown in FIG. 6, according to a further form of the present invention, the air mattress structure has a rectangular shape. The sponge layer 33 has four sides, and the surface area of each of the first line low density polyethylene layer 32, the first nylon layer 31, the second line low density polyethylene layer 34, and the second nylon layer 35 is greater than that of the sponge layer 33 for enclosing all of the four sides of the sponge layer 33 in the middle of the laminated layers.

Although the present invention has been described with a certain degree of particularity, it is to be understood that the present disclose has been made by way of example only and that many other possible modifications and variations can be made without departing from the scope of the present invention.

I claim:

1. An air mattress structure comprising a mattress body inflatable through a valve, said mattress body including:

a sponge layer formed in a predetermined color and having opposing first and second faces;

a first line low density polyethylene layer laminated on said first face of said sponge layer, said first line low density polyethylene layer being transparent;

a second line low density polyethylene layer laminated on said second face of said sponge layer, said second line low density polyethylene layer being transparent, a perimeter portion of said first line low density polyethylene layer being secured to a corresponding perimeter portion of said second line low density polyethylene layer;

a first nylon layer laminated on said first line low density polyethylene layer, said first nylon layer being transparent for visualization of said sponge layer through said first line low density polyethylene layer; and, a second nylon layer laminated on said second line low density polyethylene layer, said second nylon layer being transparent for visualization of said sponge layer through said second line low density polyethylene layer.

* * * * *